US006358116B1

(12) United States Patent
Strother

(10) Patent No.: US 6,358,116 B1
(45) Date of Patent: Mar. 19, 2002

(54) THROWN WAFER FAILSAFE SYSTEM FOR CHEMICAL/MECHANICAL PLANARIZATION

(75) Inventor: Bernard J. Strother, Mason, OH (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/571,886

(22) Filed: May 15, 2000

(51) Int. Cl.[7] ..... B24B 1/00

(52) U.S. Cl. ..... 451/5; 451/5; 451/8; 451/9; 451/10; 451/11; 451/36; 451/41; 451/56; 451/60; 451/285; 451/287; 451/288

(58) Field of Search ..... 451/5, 8, 9, 10, 451/11, 36, 41, 56, 60, 285, 287, 288

(56) References Cited

U.S. PATENT DOCUMENTS 5,833,519 A * 11/1998 Moore ..... 451/56

* cited by examiner

*Primary Examiner*—Joseph J. Hail, III
*Assistant Examiner*—Shantese McDonald
(74) *Attorney, Agent, or Firm*—Fish & Richardson P.C.

(57) ABSTRACT

An improved wafer polishing technique. The apparatus as configured prevents the destruction of a thrown wafer and facilitates quick restart of the polishing process on a previously thrown wafer without shutting down or reinitializing the apparatus. When a thrown wafer is detected, a part is moved quickly, e.g., by using a supplemental part raising element.

19 Claims, 4 Drawing Sheets

THROWN WAFER FAILSAFE SYSTEM FOR CHEMICAL/MECHANICAL PLANARIZATION

BACKGROUND

The present invention pertains to surface machining of semiconductor wafers, and in particular to chemical/mechanical polishing (CMP) of silicon and other types of semiconductor wafers.

In the commercial production of semiconductor wafers, a semiconductor wafer undergoes successive operations in which relatively thin layers of conductive, semiconductive and dielectric materials are formed on one of the wafer's major surfaces by metalization, sputtering, ion implantation and other conventional techniques. Although the thickness of such layers is measured in terms of microns or micro inches, the exposed surfaces must be polished flat, in preparation for successive layering operations.

A variety of equipment is commercially available for planarizing and otherwise preparing wafer surfaces using a variety of techniques, including chemical/mechanical polishing (CMP) processes. Typically, the layered surface (device side) of the wafer is placed face down on a polish pad carried on a rotating table. A chemically active media, which may also have abrasive particles, is introduced onto the polish table from a dispenser. This media migrates between the wafer and the polish pad.

A carrier and compressible backing pad apply a downforce to the back side of the wafer, pressing the device side of the wafer against the polishing pad surface. The polishing pad is supported in place by a polishing tub. An inner sidewall of this tub provides a fence around the circumference of the pad. A guard arm extends laterally over the moving polish pad surface and functions to condition this surface as the wafer is polished.

The carrier applying downforce to the wafer is rotatably driven about a vertical axis so as to rotate the wafer with respect to the moving polish pad surface, thereby increasing the relative motion between the wafer and the polish pad. The carrier and hence the wafer is also reciprocated back and forth along an arc, usually intersecting a radial line originating at the center of the polish pad. An optical measuring device, such as that manufactured by NOVASCAN, is coupled to the polishing system. This device optically measures the thickness of the wafer and sends a signal to the polishing system when the proper thickness is obtained.

Wafers are polished in batches. At the beginning of a polishing process a technician is required to program a number of parameters into the system's computer. Such parameters include defining (i) the polishing interval, (ii) the rotatably-driven speed of the carrier, (iii) the number of wafers in the batch, and (iv) other related specifications.

In order to maintain the wafer underneath the carrier despite sideways or lateral dislodging forces, the carrier exerts a suction force to the backside of the wafer. This force is often insufficient to retain the wafer, thereby causing it to become dislodged. It has been observed in commercial wafer polishing operations that, despite precautions to the contrary, a dislodged wafer is thrown with destructive force against the fence of the polishing tub. In certain cases, a thrown wafer was observed to break after coming to rest on the polish pad, when it then crashes against either the laterally extending carrier or guard arm.

A sensor mounted on the carrier detects a thrown wafer condition. An audible alarm is then immediately sounded. A technician typically shuts down the system completely to remove the broken wafer. At this time, the optical measuring device is reset and the system reinitialized. This can consume time and cost.

SUMMARY OF THE INVENTION

The present disclosure is directed to an improved wafer polishing apparatus and method of operating such apparatus. A method of facilitating quick restart of a polishing process on a previously thrown non-broken wafer, is disclosed that carries out processing a wafer, identifying a thrown wafer condition, transmitting a signal to the main controller indicative indicating the thrown wafer condition, and causing, an element to be raised to prevent contact with a thrown wafer.

DETAILED DESCRIPTION

Figure 1:
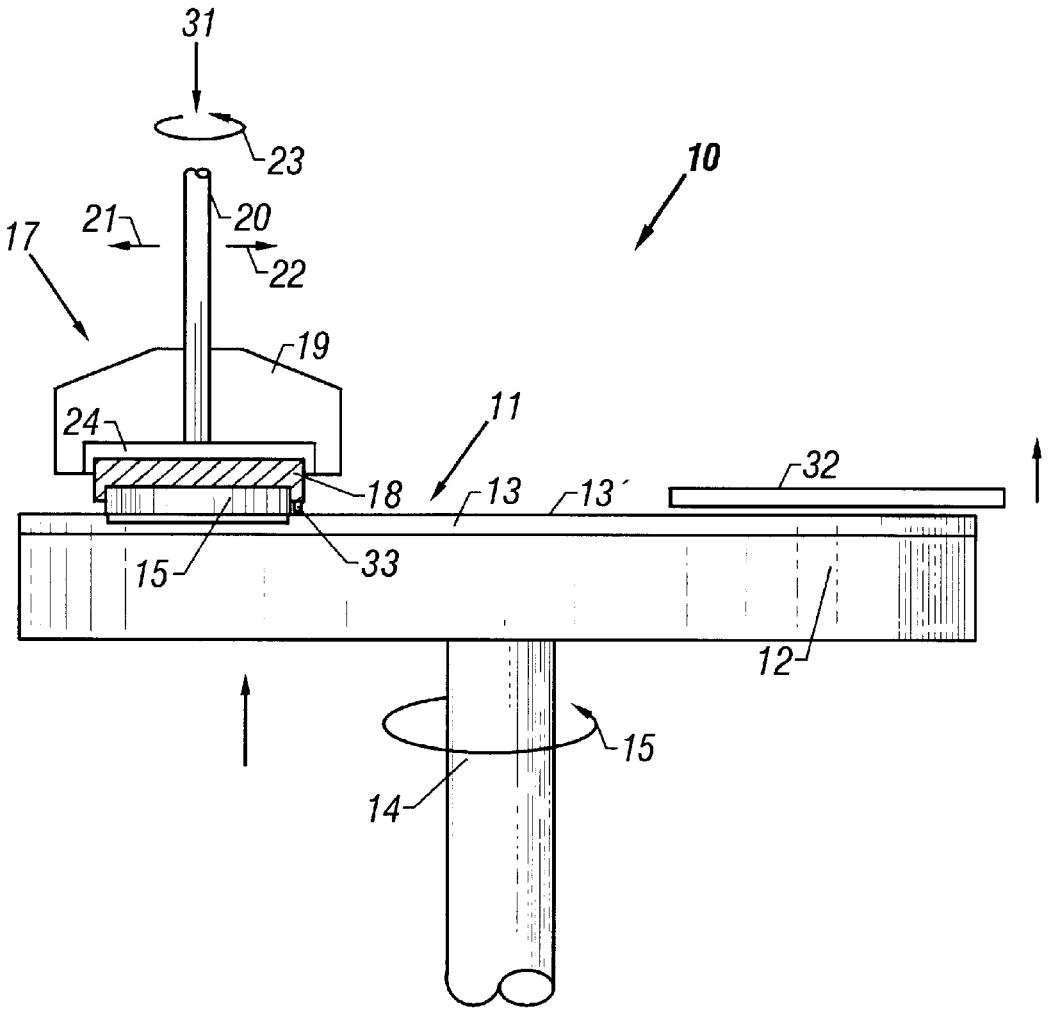
FIG. 1 is a schematic illustration of a CMP apparatus for polishing a semiconductor wafer arranged in such manner as to prevent a thrown wafer from becoming damaged.

FIG. 1 shows a typical CMP apparatus for polishing a semiconductor wafer. The polishing apparatus shown generally as 10 includes a polishing wheel assembly shown generally as 11. The polishing wheel assembly includes a rotatable table 12 to which is attached a polish pad 13. The polish pad 13 includes a polish pad surface 13' facing upward. A conventional pad is a Rodel IC1000 polyurethane pad. The rotatable table 12 is rotated by shaft 14 in the direction indicated by arrow 15. The polish pad 13 is typically polyurethane foam having open pores and is about 22 inch in diameter and 0.050 inch thick.

A wafer carrying assembly shown generally as 17 includes a wafer carrier 18, shown holding wafer 16. A pressure plate 19 is secured to the wafer carrier 18 for applying pressure to the wafer carrier and wafer. In the embodiment shown, a hollow spindle 20 is coupled to the pressure plate and driven by an externally coupled device that moves the wafer carrier assembly 17 in the directions shown by the arrows 21, 22 and 23. As shown by the arrow 31, pressure can be applied to the spindle 20 by a weight load, and/or a pressurized fluid such as compressed air can be used to exert pressure on the upper surface of wafer carrier 18 by supplying the pressurized fluid to space 24 of the wafer carrier assembly. The force is essentially uniform over the surface of the wafer carrier and wafer. The wafer carrier assembly in a preferred embodiment moves over one-half of the pad surface 13. A guard arm is shown positioned on the other half of the pad surface 13. The guard arm operates in conventional manner to condition the polishing pad surface 13' which is rotated by the rotatable table 12 upon which it is carried.

The inventor has found that a thrown wafer has a generally consistent trajectory path. In accordance with the preferred embodiment, it has been determined that by selectively positioning the guard arm 32 relative to the carrier assembly, it is possible to prevent a thrown wafer from crashing into the guard arm 32, immediately upon its becoming dislodged. Of course, the optimum position of the guard arm 32 is configuration specific and can only be determined by simple experimentation.

During polishing, a slurry is applied by a sprayer means to the surface of the pad 13. The slurry is forced into the open pores of the polish pad 13 and also forms a layer of slurry on the pad surface which flows between the wafer 16 carried by the wafer carrier assembly 17 and the polishing pad 13 of polishing wheel assembly 11. Any suitable slurry may be used. Silica based slurries such as Cabot SC112 are preferred.

As previously explained, the rubbing friction between a wafer and the polish pad surface 13' could cause the wafer 16 to slide laterally away from the wafer carrier 18, until it is eventually fully freed and released with great force toward the periphery of the polish pad 13. A sensor 33 mounted on the carrier detects a thrown wafer condition. In response thereto, an alarm sounds, and the polishing operation is terminated.

Figure 2:
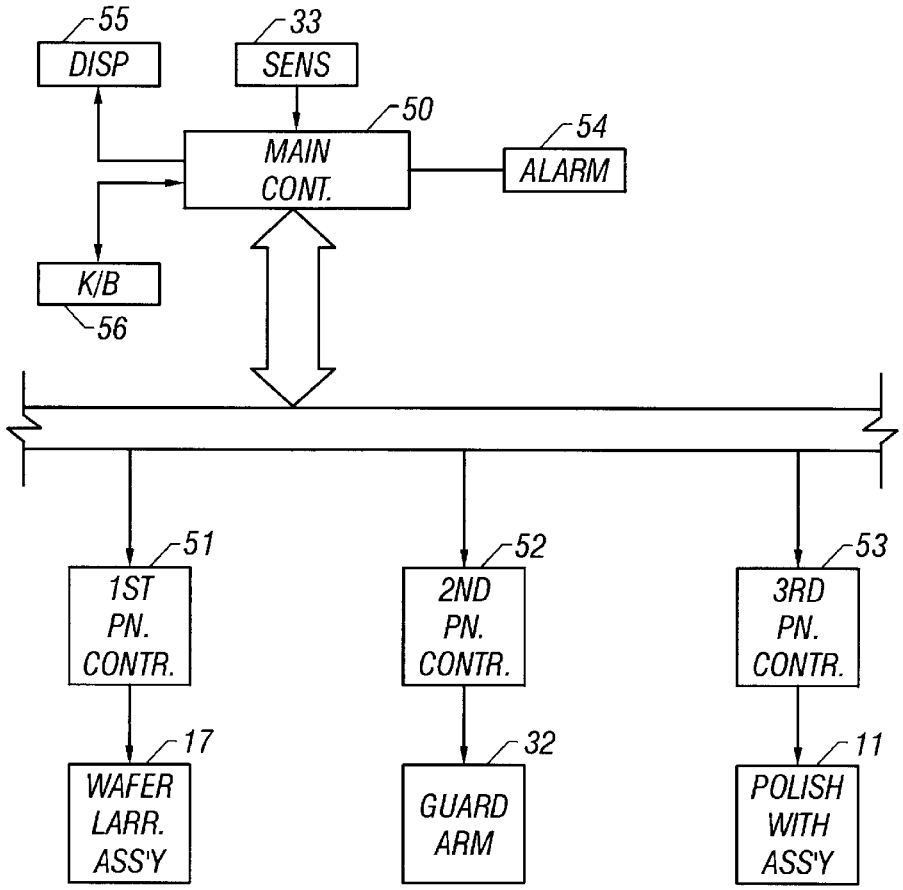
FIG. 2 is a high level block diagram of a CMP apparatus constructed in accordance with the present invention.
Figure 5:
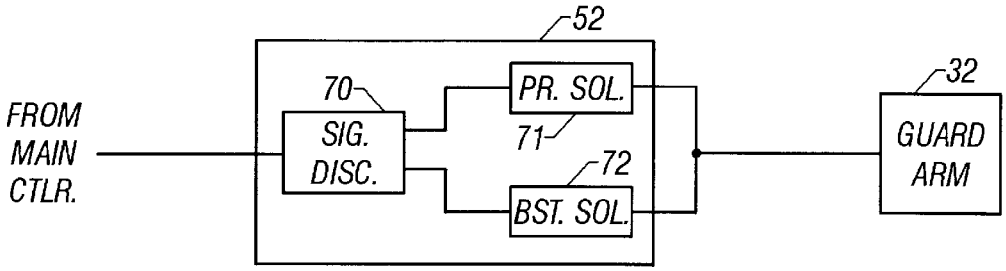
FIG. 5 is an operational flow diagram of the main controller shown in FIG. 2.

A block diagram of the essential operating components constituting the CMP apparatus 10 is shown in FIG.2. The main controller 50 provides overall system control. The main controller 50 is shown generally connected to a first pneumatic controller 51, a second pneumatic controller 52 and a third pneumatic controller 53. Each of the first, second and third pneumatic controllers 51–53 receive electronic signals from the main controller 50 at appropriate times to control the driving speeds and/or raising and lowering action of each of the wafer carrier assembly 17, and guard arm 32, and the polishing wheel assembly 11, respectively.

A display 55 and keyboard 56 are coupled to the main controller to allow a technician to monitor a polishing operation as well as to enter batch specific polishing specifications.

Figure 3:
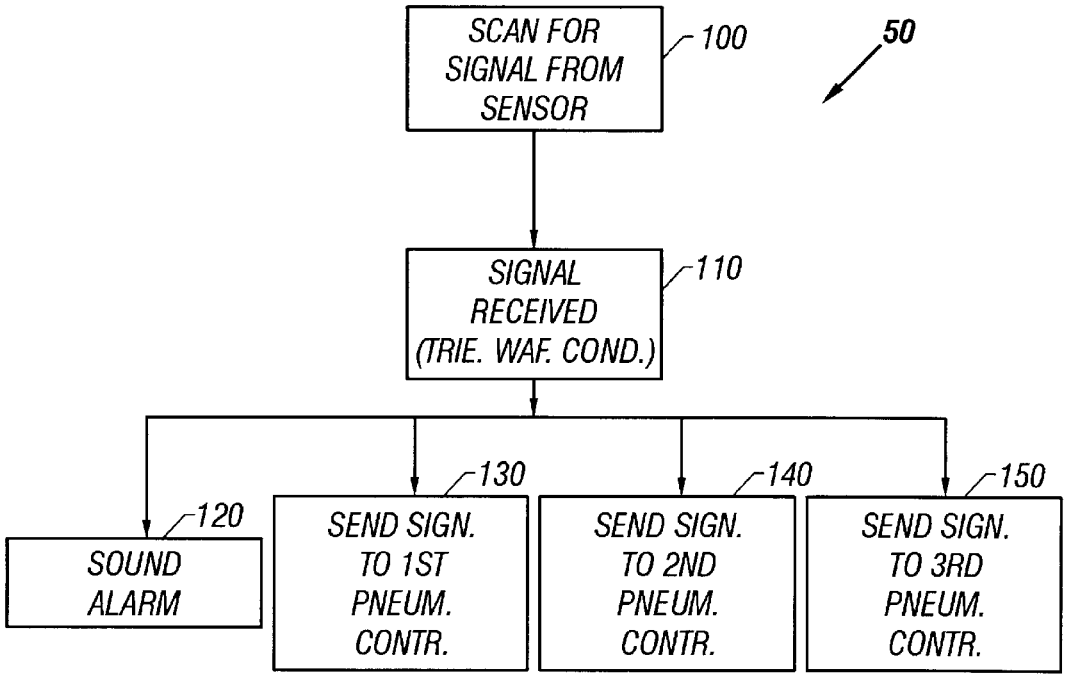
FIG. 3 is a block diagram of the second pneumatic controller in FIG. 2.

The basic operational flow of the main controller 50 is shown in FIG.3. The main controller continually scans for a signal from sensor 33 indicative of a thrown wafer condition (step 100). Upon receipt of such signal (step 110), main controller 50 sounds an alarm 54 alerting a technician (step 120). Simultaneously with the sounding of the alarm 54, main controller 50 generates appropriate signals to each of the first, second and third pneumatic assemblies 51–53 (steps 130, 140, 150). In response, first pneumatic assembly 51 powers a motor in the wafer carrier assembly 17 to cause the vertical raising of the wafer carrier 18. Similarly, pneumatic assembly 52 powers a motor coupled to the guard arm to immediately raise the guard arm. In similar fashion, the third pneumatic assembly 53 is powered to significantly slow down the rotating speed of the rotatable table 12.

The wafer carrier 18 and the guard arm 32 are raised to prevent a dislodged wafer from crashing against either component. The slowing of the rotatable table speed provides an improved window of opportunity within which to raise either the carrier 18 or guard arm 32. A thrown wafer typically bounces of a surrounding wall around the periphery of the polish pad 13. Eventually, the thrown wafer comes to rest at or near the edge of the polish pad 13 where it is carried under rotational action circumferentially thereon. Unless the guard arm 32 and/or carrier are raised in time, the rotationally-carried wafer will crash. By slowing the traveling speed of the wafer (i.e., reducing the speed of the rotating table 12), the wafer must travel a similar distance in greater time to reach either the guard arm 32 and carrier 18.

Figure 4:
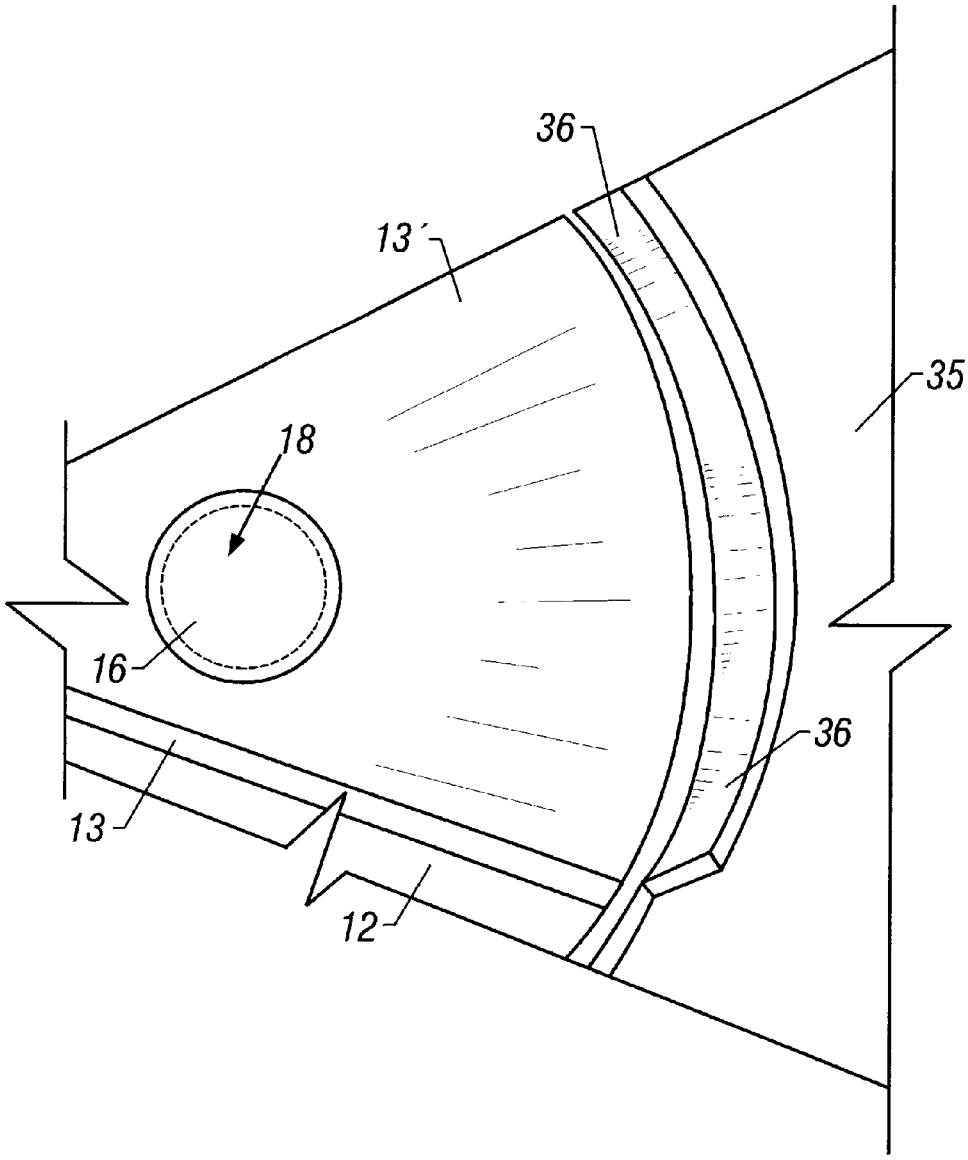
FIG. 4 is a partial perspective view of a portion of the polish pad and of the padded fence surrounding an outer periphery of the polish pad portion.

FIG. 4 is a partial perspective view of a portion of the polish pad and of a padded fence surrounding an outer periphery of the polish pad portion. The inventors have found that by also padding the surrounding wall 35 around the periphery of the polish pad 13, the likelihood of a wafer breakage at initial impact is significantly improved. In the illustrative embodiment, this is accomplished by providing a removable, padded fence 36 about the polish pad. The padded fence 36 is preferably comprised of a rubber polyurethane stripping with adhesive backings so the padded fence can be periodically removed as debris and other particles become trapped on the surface thereof.

The combination of padding the surrounding periphery and the lifting of the guard arm and/or carrier out of the moving path of a thrown wafer, together with the slowing of the rotating table, reduces the possibility of thrown wafer being broken.

In accordance with the embodiment, a thrown (non-broken) wafer is re-mounted by a technician onto the rotatable wafer carrier 18 and the polishing process restarted without substantial technician intervention and without fully shutting down the system.

A suitable CMP apparatus for practicing the present invention are polishing devices manufactured by WESTECH, such as model 372M. Current versions of such polishing devices are provided without a padded fence as proposed herein. Consequently, a large number of thrown wafers are broken in large part due to the initial impact of a thrown wager against an unpadded surrounding wall. In addition, the WESTECH guard arm is not automatically lifted in response to a thrown wafer condition thus causing thrown and yet-non-broken wafers to crash thereon and break.

It should appreciated that a device such as the WESTECH device can be readily adapted to include the new feature of a padded fence, as well as the added functionality of raising the guard arm, raising the carrier, and reducing the speed of the rotating table, under the now timed-control of the existing main controller.

Current versions of existing devices, such as those manufactured by WESTECH, were not designed to fast lift the guard arm or carrier. Fast lift, in accordance with the preferred embodiment, is achieved by use of a second pneumatic controller 52 configured substantially as shown in FIG. 2. When a thrown wafer condition is detected, the main controller 50 transmits a signal to the second pneumatic controller 52. A signal discriminator 70 analyzes the signal to determine whether the signal from the main controller 50 is for normal operation of the guard arm 32 or in response to a thrown wafer condition. In the former case, the discriminator 70 fires up a primary solenoid 71 to slowly raise the guard arm 32. In a thrown wafer situation, the discriminator 70 fires up both the primary solenoid 71 as well as a boost solenoid 72 to more quickly raise the guard arm 32. The firing of the boost solenoid 72 only when a wafer is thrown significantly cuts down on the wafer of the guard arm during normal operation.

Because a thrown wafer is generally thrown away from the laterally extending position of the carrier 18, a boost solenoid is generally not necessary on many configurations. The lift speed of the carrier is fast enough to ensure its being moved before possible contact with a thrown wafer. Of course, a boost solenoid could be employed if a given CMP configuration would render it necessary to reduce contact with a thrown wafer.

As previously explained, the padded fence 36 is preferably comprised of rubber polyurethane stripping with adhesive backings. However, any material capable of absorbing the impact of a thrown wafer to prevent it from breaking is considered a suitable equivalent. It is envisioned that the padded fence 36 include any suitable adjusting means to facilitate sizing of the padded fence for use with different CMP devices.

Although only a few embodiments have been described in detail above, other modifications are possible. For example, other CMP machines, besides the ones specifically described herein, can be used.

What is claimed is:

1. A method of facilitating quick restart of a polishing process on a previously thrown non-broken wafer, comprising:

processing a wafer;

identifying a thrown wafer condition during said processing;

forming a signal indicating the thrown wafer condition; and causing an element to be raised to prevent contact with a thrown wafer.

2. The method of claim 1, wherein said causing comprises raising a rotatable carrier; raising a guard arm; and causing a rotatable table to reduce its speed.

3. The method of claim 2, wherein said raising comprises operating a first solenoid which is used for normal operation of the guard arm and also operating a boost solenoid together with the first solenoid to speed up the raising of the guard arm.

4. The method of claim 2, wherein the causing of the at least one rotatable carrier and the guard arm to be raised includes raising both the carrier and the guard arm.

5. The method of claim 1, further comprising activating an alarm in response to the signal.

6. A quick-restart wafer polishing apparatus comprising:

a polish pad including a polish pad surface and a rotatable table;

a rotatable carrier driven about a vertical axis transverse to the polish pad surface a polishing tub extending from the polish pad surface, across the polish pad surface, the rotatable carrier being adapted to apply a downward force to a wafer during a polishing process;

a guard arm extending laterally across the polish pad surface and movable along a vertical direction for conditioning the polish pad surface;

a sensor for generating a signal indicative of a thrown wafer condition; and a main controller to rapidly raise at least one of the rotatable carrier and the guard arm substantially immediately in response to the signal to prevent contact with a thrown wafer.

7. The apparatus of claim 6, further comprising a first controller which drives the carrier, a second controller which drives the guard arm and a third controller which drives the rotatable table, each of which is driven by the main controller.

8. The apparatus of claim 7, wherein at least one of the first, second and third controllers includes a boost solenoid activated by the main controller and operable during a thrown wafer condition.

9. The apparatus of claim 7, wherein the main controller further activates the third controller to reduce the speed of the rotatable table in response to the signal.

10. The apparatus of claim 7, wherein in response to the signal the main controller generates:

(a) a first signal to the first controller to cause the rotatable carrier to become raised;

(b) a second signal to the second controller to cause the guard arm to become raised; and (c) a third signal to the third controller to cause the rotatable table to reduce its speed.

11. The apparatus of claim 10, wherein at least one of the first, second and third controllers are pneumatic controllers.

12. The apparatus of claim 11, wherein the second controller includes a first solenoid operable under normal operation of the guard arm and a boost solenoid activated by the second signal and operable together with the first solenoid to speed up the raising of the guard arm.

13. The apparatus of claim 6, wherein the polishing tub includes an inner sidewall, the inner sidewall defining a padded fence disposed at least partially around a periphery of the polish pad.

14. The apparatus of claim 13, wherein the padded fence is removable.

15. The apparatus of claim 14, wherein the removable padded fence is comprised of rubber polyurethane.

16. The apparatus of claim 15, wherein the removable padded fence is adjustable in size.

17. The apparatus of claim 13, wherein the padded fence is comprised of rubber polyurethane stripping.

18. The apparatus of claim 6, wherein the guard arm is positioned away from an expected trajectory of a thrown wafer.

19. The apparatus of claim 6, further comprising an alarm coupled to the main controller, the alarm being activated in response to the signal.

* * * * *